United States Patent [19]

Brezette et al.

[11] Patent Number: 4,829,623

[45] Date of Patent: May 16, 1989

[54] PAD ATTACHMENT FOR PAINT ROLLER ASSEMBLIES

[75] Inventors: Michael W. Brezette, Waukesha; Robert A. Schaffer, Greenfield; Fredrick B. Burns, South Milwaukee; Howard R. Moon, Fort Atkinson, all of Wis.

[73] Assignee: EZ Paintr Corporation, Milwaukee, Wis.

[21] Appl. No.: 46,327

[22] Filed: May 6, 1987

[51] Int. Cl.[4] ..... B05C 17/02

[52] U.S. Cl. ..... 15/246; 15/210 R; 15/230.11

[58] Field of Search ..... 15/230.11, 118, 248 A, 15/210 R, 114; 29/110.5, 120

[56] References Cited

U.S. PATENT DOCUMENTS 3,346,899 10/1967 Murphy ..... 15/230.11
3,359,589 12/1967 Moore ..... 15/210 R
3,942,209 3/1976 Walls ..... 15/230.11
4,219,899 9/1980 Zurawin et al. ..... 15/210 R
4,528,712 7/1985 Leibow ..... 15/230.11

FOREIGN PATENT DOCUMENTS 1377971 12/1974 United Kingdom ..... 15/230.11

*Primary Examiner*—Edward L. Roberts
*Attorney, Agent, or Firm*—Baker & McKenzie

[57] ABSTRACT

A pad attachment for a paint roller assembly including a pad holder affixed to a roller type paint applicator. The pad holder retains a paint trimming and smoothing material in a form of a fabric or foam. The material retained by the holder is positioned to smooth or otherwise treat the paint being applied by the roller during a painting application. In addition, the material may function to trim or "cut in" at the interface of a surface adjacent the surface being painted.

11 Claims, 2 Drawing Sheets

PAD ATTACHMENT FOR PAINT ROLLER ASSEMBLIES

BACKGROUND OF THE INVENTION

1. Field of the Invention

The present invention generally relates to painting implements and, more particularly, is concerned with an attachment pad for use with paint roller assemblies for smoothing or otherwise treating the paint film being applied by the roller and for trimming or "cutting in" along surfaces adjacent to the surface being painted.

2. Description of the Prior Art

Rollers of many designs are commonly used applicators of paint and the like to surfaces. Although paint rollers are capable of superior results, the quality of application and texture of the applied paint is largely dictated by factors such as the type of roller, the properties of the paint, and the physical characteristics of the surface being painted. Known paint brush constructions have been deficient in providing an accessory or cooperating element that is capable of being affixed to the paint roller assembly for improving the quality or modifying the appearance of the film being applied.

The inherent configuration of a paint roller also causes difficulty in painting or trimming corners at the intersection of a surface adjacent the surface being painted, such as along a ceiling, door frame, and the like. As a result, it is often necessary to trim corners of intersecting surfaces by using brushes or other separate devices.

Consequently, a need exists for improvements in painting of surfaces with rollers by which the applied paint can be further enhanced through smoothing or other treatment during the painting operation. A need further exists for improvements in the trimming of intersecting surfaces while using a paint roller assembly.

SUMMARY OF THE INVENTION

It is an objective of the invention to provide a unitary pad attachment for a paint roller assembly to provide a paint trimming an surface treatment capability to the paint film being applied. The attachment pad device of the invention is directly affixed to the roller assembly in a manner that a material, such as a fabric or foam face contacts the applied paint film for smoothing or creating some other aesthetic affect. In addition, the attachable pad device herein disclosed is capable of a trimming or "cutting in" operation at the corners of intersecting surfaces during use of the roller. The foregoing enhancement of the paint surface and trimming capability of the invention are attained by an inexpensive device that is lightweight and does not interfere onto the expected ease of loading paint with a roller.

DESCRIPTION OF THE PREFERRED EMBODIMENTS

Figure 1:
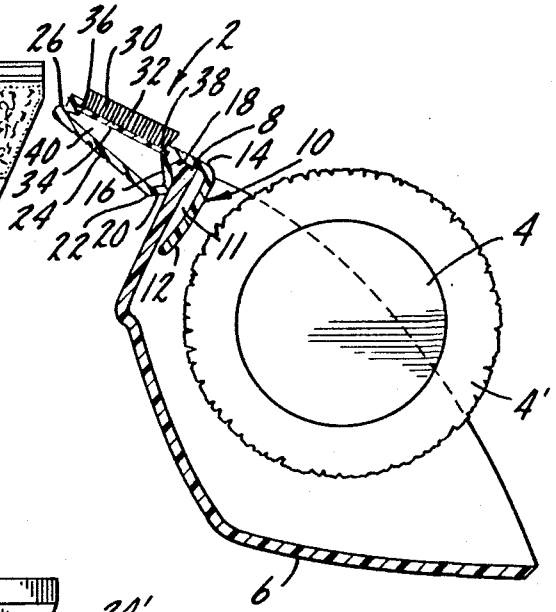
FIG. 1 is a side elevational view, with parts in section, of a first embodiment of the pad attachment device for paint roller assemblies of the invention.

Referring now to FIG. 1, there is illustrated a first embodiment of the pad attachment device of the invention shown affixed to an existing paint roller assembly and generally designated by reference numeral 2. The known paint roller assembly includes a paint roller 4 having a circumferentially arranged fabric or fiber material 4' that absorbs paint and applies a film to the surface being painted. In the assembly shown in FIG. 1, the roller 4 is rotatably mounted by means (not shown) to a paint shield housing 6 also of a known configuration. The housing 6 may include a handle for manipulation of the roller assembly in use and end walls (not shown). Although the invention is shown in conjunction with a paint shield housing, the invention may also be attached to other paint roller assemblies by suitable techniques (not shown).

Figure 3:
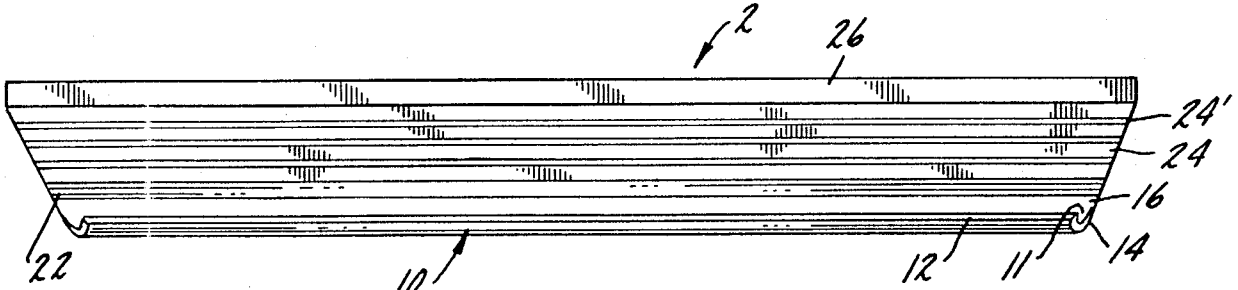
FIG. 3 is a top plan view of the pad attachment device shown in FIG. 2 having a modified trapezoid configuration.

The pad attachment device 2 is mounted on an enlarged lip 8 of housing 6 and extends in substantially parallel relationship to the axis of rotation of the roller 4. The pad attachment device 2 includes a single piece, pad holder 10, which may be molded or otherwise formed from a plastic material. Pad holder 10 is arranged to snap into fixed position substantially over the length of the enlarged lip 8 of the paint shield housing 6. As seen in FIGS. 1 and 3, the pad holder 10 includes a retention pocket 11 formed by a somewhat curved inner housing wall 12, an integral end surface 14, and an outer section 16 disposed on the surface of lip 8 as seen in FIG. 1. The outer portion 16 is formed with a recess 18 having an approximate shape corresponding to the outer enlarged face of lip 8. The enlarged lip 8 may be positioned into the pocket 11 of pad holder 10 with recess 18 snapping into retention on the lip 8.

As further seen in FIG. 1, a portion 20 of the pad holder 10 angularly diverges outward from the outer surface of the housing 6 and terminates with a protuberance 22. A wall 24 projects outward from protuberance 22 and housing 6, and terminates with an outer edge portion 26 that retains the outer edge of a pad 30. The wall 24 may have a series of strengthening slots 24 as best shown in FIG. 3. As seen in FIG. 1, the pad includes a painting face 32 formed from a suitable material, such as a fabric, foam and the like, that is adhesively bonded to a rigid or semi-rigid backing member 34 by any known technique. The pad 30 is affixed to the holder 10 by retention in a pair of opposed open-ended slots 36,38 respectively formed on outer edge portion 26 and outer section 16 as seen in FIG. 1. The pad 30 may be replaced or mounted in position by being slid lengthwise in the open ended slots 36,38 or preferably, in the embodiment of FIG. 1, the holder 10 is hollow in enclosed area 40.

The holder 10 and pad 30 are arranged to span approximately the length of the housing shield 6 adjacent the roller 4 to provide contact with the surface being painted. As should be apparent in the foregoing description, the painting face 32 trails the roller 4 as it applies paint to a surface and acts to smooth the film applied by the roller. The surface of face 32 is disposed in a plane that is approximately tangential to the interface between the roller 4 and the surface being painted. Although the fabric painting face 32 shown in FIGS. 1 and 2 acts to smooth a paint film, the configuration and texture of the face 32 can be modified to create other painting effects where desirable. While the pad at attachment device 2 is further shown as an attachable fixture to the paint roller housing 6 in FIG. 1, it is within the scope of the invention to mold or otherwise fabricate the housing 6 and pad attachment device 2 as a unitary body (not shown) with the pad 30 being insertable or removable in slots 36,38

Figure 2:
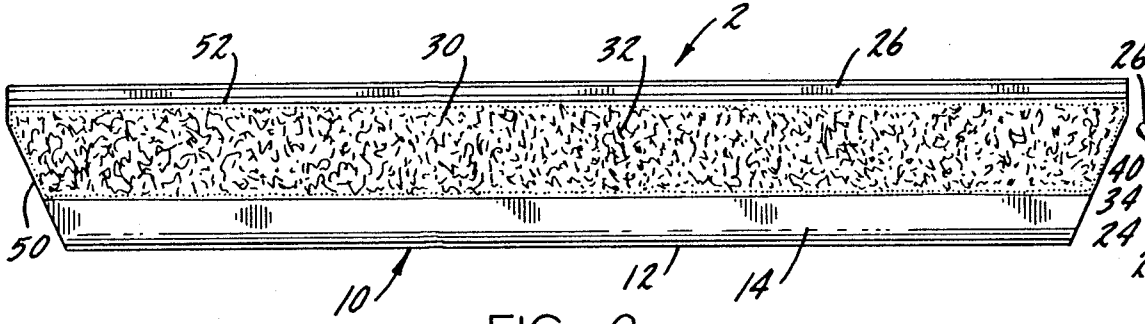
FIG. 2 is a bottom plan view of the paint face of the pad attachment device shown in FIG. 1 having a trapezoid configuration.

In FIG. 2, the paint face 32 is shown having a trapezoid shape 50, with the largest side 52 being the farthest from the axis of rotation of the roller 4. The face 32 forms an extended outward dimension in vicinity of side 52.

Figure 4:
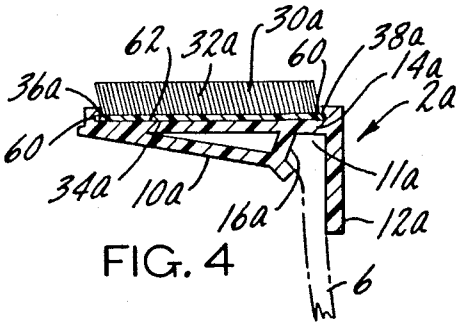
FIG. 4 is a partial side elevational view, with parts in section, of another embodiment of the pad attachment device of the embodiment showing a first technique for attaching a paint pad and a modified base.

Referring now to FIG. 4, there is another embodiment of the pad attachment of the invention generally designated as reference numeral 2*a*. The pad holder 10*a* is modified from the holder shown in preceding FIG. 1 and includes a solid molded configuration. The pocket 11*a* formed by portions 12*a*, 14*a*, and 16*a* snaps on the shield housing 6 in a similar manner as previously described. The pad 30*a* includes a fabric painting face 32*a* and a semi-rigid backing member 34*a* of any selected material. The backing member 34*a* includes opposed extended portions 60 that slide into the slots 36*a* and 38*a* formed in the bottom of body 10*a*. The slots 36*a* and 38*a* confront each other adjacent to a cutout area 62 of the holder 10*a* which receives the pad 30*a*.

Figure 5:
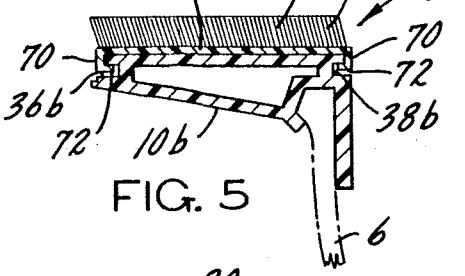
FIG. 5 is a partial side elevational view, with parts in section, of still another embodiment of the pad attachment device of the invention showing an alternative technique for attaching the paint pad.

Referring now to FIG. 5, there is illustrated still another embodiment of the pad attachment 2*b* of the invention. The pad holder 10*b* of pad attachment 2*b* has a slightly modified design than the holder 10*a* shown in FIG. 4. Specifically, the bottom face of the pad holder 10*b* is flat, while the slots 36*b* and 38*b* are formed on the lower outer sides of the pad holder 10*b*. The edge portions 70 of the semi-rigid backing material 34*b* are bent back in a modified U-shaped configuration so that the inner directed edges 72 engage the slot 36*b*, 38*b*. The pad 30*b* with face 32*b* may be slid into position lengthwise as in the previous embodiments.

Figure 6:
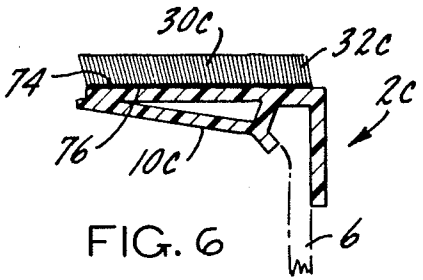
FIG. 6 is a partial side elevational view, with parts in section, of still another embodiment of the pad attachment device of the invention showing a third technique of attachment of the fabric painting pad.

Referring now to FIG. 6, there is illustrated another embodiment of the pad attachment device of the invention, generally designated by reference numeral 2*c*. The pad holder 10*c* of pad attachment device 2*c* is similar to the pad holders of the preceding embodiments, except that the slots for retention of the painting faces have been eliminated. In addition, paint face fabric 32*c* is directly affixed to the bottom 74 of the holder 10*c* by use of a suitable adhesive 76.

Figure 7:
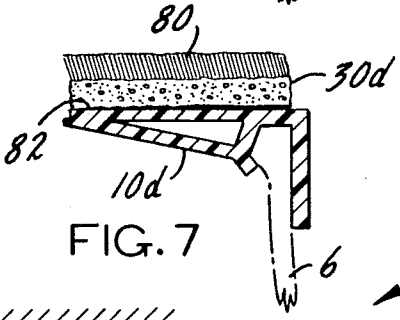
FIG. 7 is a partial side elevational view, with parts in section, of another embodiment of the pad attachment device of the invention having a flocked foam painting face.

Referring now to FIG. 7, there is illustrated another technique for attaching the paint face to the holder. The holder 10*d* is the same general configuration as the holder 10*c* of embodiment of FIG. 6, but the painting face 30*d* comprises a flocked foam painting face 80 that is affixed to the face of the holder by an adhesive bond 82.

In the foregoing description of the embodiments of FIGS. 4–7, four alternative ways for attachment and forms of painting face have been described. Each of these techniques can be utilized in conjunction with the holder device 10 of FIG. 1, if desired.

Figure 8:
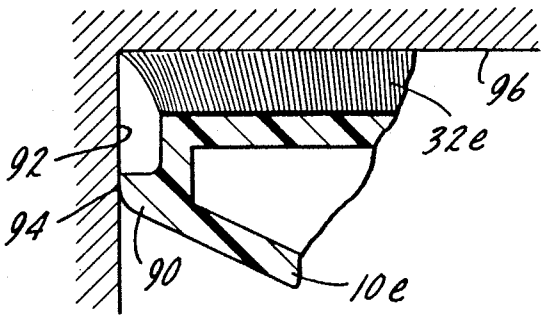
FIG. 8 is a partial side elevational view, with parts in section, of still another embodiment of the pad attachment device having an extended portion for trimming.

Referring to FIG. 8, the holder 10*e* of the invention is shown formed with extended portion 90 along its outer face in parallel relationship to the axis of rotation of the roller (not shown). The extended portion 90 is intended to contact an adjacent wall 92 at edge 94 to space the remaining portions of holder 10*e* from the wall. In this position, the painting fabric face 32*e* projects outward when pressed against surface 96 to approach the intersection of the surfaces 92 and the painting surface 96 so that the face with retained paint can trim or cut in along a ceiling, door frame or other surface adjacent to the frame being painted. This offers an improved ability of a paint roller device to trim corners which is difficult with present designs. The extended portion 90 is offset from the face 32*c* to prevent paint from migrating to the edge 94 for unsatisfactory trimming results.

Figure 9:
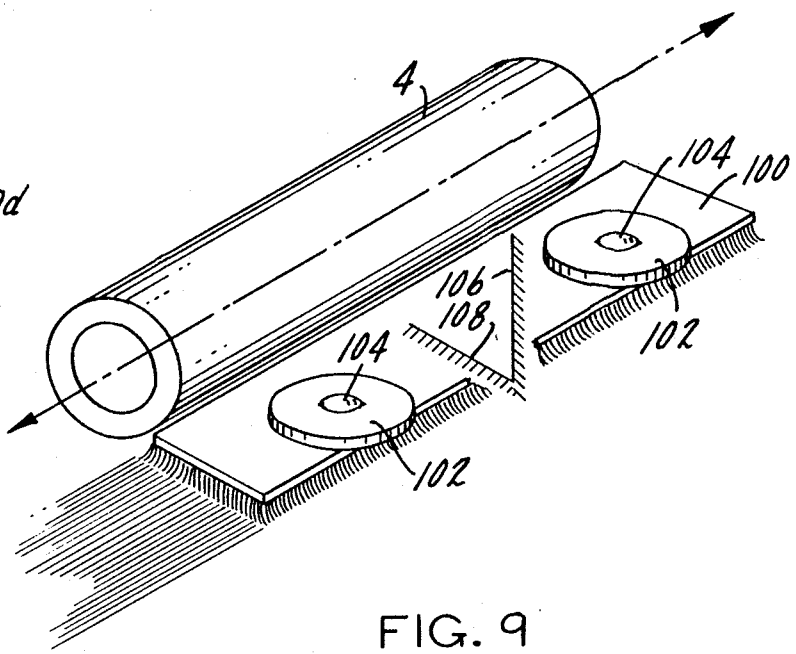
FIG. 9 is a side perspective illustration of still another embodiment of the pad attachment device of the invention having wheels.

Referring now to FIG. 9, a modification of the trimming capability of the pad attachment device of the invention is shown. Although the holder of the facing can encompass any of the foregoing shapes, for purpose of illustration the pad holder 100 is shown with a flat configuration. A pair of wheels 102 are mounted in shafts 104 for rotation about axls extending perpendicular to the axis of rotation of roller 4. The wheels 102 permit the attachment device to be moved along wall 106 in parallel relation to the axis of rotation of the roller 4, such as during lifting the roller or otherwise traversing the surface 108 being painted for improved trimming results.

The foregoing detailed description has been given for clearness of understanding only and no unnecessary limitations should be understood therefrom as some modifications will be obvious to those skilled in the art.

We claim:

1. For use in a paint roller assembly having a shield having a front and rear edge portion, a pad device, said pad device including, in combination, a paint pad having a painting face, a pad holder adapted to support said paint pad from the front edge portion of the shield in a position in which the painting face is positioned to press against a painting surface, said pad holder including supporting means for maintaining the paint pad and the paint pad holder in a fixed relationship to the front edge portion of the shield, said painting face comprising a layer of surface treating material arranged to contact the surface being painted, said layer of surface treating material being a layer of fabric affixed to said pad holder, said painting face including a backing member, said layer of fabric being affixed to said backing member, said pad holder including a pair of spaced slots, said backing member being removably retained in said slots.

2. The painting pad device of claim 1 wherein said pad holder includes a cutout portion for receiving said painting face, said slot being formed in said holder adjacent said cutout portion.

3. The painting pad device of claim 1, wherein a portion of said fabric layer of material is capable of projecting beyond at least a portion of said pad holder for trimming corners formed by intersecting surfaces.

4. The painting pad device of claim 3 wherein said pad holder includes an extended portion projecting beyond said pad holder opposite the pad holder edge which is adjacent the pad holder supporting means, said extended portion having an edge arranged to contact an intersecting surface which is adjacent to a surface being painted.

5. The painting pad device of claim 1 wherein said pair of slots open in opposite directions on said holder, said backing member having edge portions being bent back to form edges to engage said pair of slots.

6. A pad attachment for removable attachment to the paint shield housing of a paint roller assembly comprising:

a pad holder for positioning a painting pad having a painting face against a surface to be painted;

said pad holder having means for removably retaining said holder to a portion of a paint shield housing of a paint roller assembly;

said pad holder being arranged to press said painting face against the surface to treat paint applied to the surface by the paint roller assembly;

said means for removably retaining said pad holder on he paint shield including a pocket to be retained over an edge portion of the paint shield housing.

7. The painting pad device of claim 6 wherein said pad holder includes a flat base surface, a layer of fabric being affixed to said base surface.

8. The painting pad device of claim 6 wherein said pad includes a layer of surface treating material which is a flocked foam, said flocked foam being affixed to said pad holder.

9. For use in a paint roller assembly having a shield having a front and rear edge portion, a pad device, said pad device including, in combination, a paint pad having a painting face, a pad holder adapted to support said paint pad from the front edge portion of the shield in a position in which the painting face is positioned to press against a painting surface, said pad holder including supporting means for maintaining the paint pad and the paint pad holder in a fixed relationship to the front edge portion of the shield, said painting face comprising a layer of surface treating material arranged to contact the surface being treated, a portion of said layer being capable of projecting beyond at least a portion of said pot holder for trimming corners formed by intersecting surfaces, said pad holder including an extended portion projecting beyond said pad holder opposite the pad holder edge which is adjacent to the pad holder supporting means, said extended portion having an edge arranged to contact an intersecting surface which is adjacent to a surface being painted.

10. The painting pad device of claim 9 wherein said extended portion is offset from said layer of material for preventing migration of paint to said extended portion.

11. The painting device according to claim 9 wherein said extended portion includes wheel means rotatably mounted for rotation on said pad holder, said wheel means permitting relative movement of said pad holder along an adjacent wall intersecting the wall being painted.

* * * * *